US007307500B2

(12) United States Patent
Gerving et al.

(10) Patent No.: US 7,307,500 B2
(45) Date of Patent: Dec. 11, 2007

(54) ARRANGEMENT USED TO FIX CONDUCTOR RAILS FOR MULTI-PHASE SWITCHGEARS

(75) Inventors: Karsten Gerving, Bonn (DE); Wolfgang Kremers, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/575,923

(22) PCT Filed: Sep. 15, 2004

(86) PCT No.: PCT/EP2004/052175

§ 371 (c)(1),
(2), (4) Date: Apr. 14, 2006

(87) PCT Pub. No.: WO2005/038840

PCT Pub. Date: Apr. 28, 2005

(65) Prior Publication Data

US 2007/0042624 A1 Feb. 22, 2007

(30) Foreign Application Priority Data

Oct. 16, 2003 (DE) ..... 103 48 092

(51) Int. Cl.
*H01H 13/04* (2006.01)

(52) U.S. Cl. ..... 335/202; 335/196; 335/197

(58) Field of Classification Search ..... 335/132, 335/196, 197, 202; 200/281
See application file for complete search history.

(56) References Cited

U.S. PATENT DOCUMENTS 4,481,555 A 11/1984 Yoshida et al. ..... 361/155
6,828,885 B1 12/2004 Dedenbach et al. ..... 335/16
7,132,913 B2 * 11/2006 Whipple et al. ..... 335/202

FOREIGN PATENT DOCUMENTS

| | | |
|---|---|---|
| DE | 32 32 173 | 3/1983 |
| DE | 296 04 726 | 5/1996 |
| DE | 198 14 410 | 10/1999 |
| DE | 199 04 355 | 8/2000 |

(Continued)

OTHER PUBLICATIONS

O. Richter et al.: "Bauelemente der Feinmechanik" [Structural Elements of Fine Mechanics], Verlag Technik berlin, 5th edition, 1952, pp. 135-139 (5 pages); [See German Examination Report for DE 103 48 092.7].

(Continued)

*Primary Examiner*—Ramon M. Barrera
(74) *Attorney, Agent, or Firm*—Darby & Darby

(57) ABSTRACT

An arrangement used to fix conductor rails for multi-phase switchgears to allow for mounting and dismantling the conductor rails in a simple manner is provided. The switchgear housing (4) comprises straight guide elements (16) which are used to receive the mounting position using the conductor rails (8). Each conductor rail (8) includes a continuous bore (22) which is covered by a receiving bore (24) when in a mounted position, the receiving bore being formed in the switchgear housing (4). Insertion journals (28) extend through the continuous bores (22) into the receiving bores (24) associated therewith and are combined with a connecting web (30) in order to form an insertion comb (26) made of an insulating material.

11 Claims, 2 Drawing Sheets

FOREIGN PATENT DOCUMENTS

| | | |
|---|---|---|
| DE | 100 36 350 | 2/2002 |
| DE | 100 61 394 | 6/2002 |
| EP | 0 604 985 | 7/1994 |
| EP | 0 645 792 | 3/1995 |
| EP | 0 948 009 | 10/1999 |

OTHER PUBLICATIONS

International Search Report for PCT/EP2004/052175 (2 pages), 2005.

German Examination Report for DE 103 48 092.7 (2 pages) with brief translation thereof (1 page), 2005.

* cited by examiner

ARRANGEMENT USED TO FIX CONDUCTOR RAILS FOR MULTI-PHASE SWITCHGEARS

The present invention relates to an arrangement for securing contact straps for multiphase switching devices, in particular for contactors, in which the incoming and outgoing contact straps secured in the switching device housing each have a connecting terminal at their outer end and lead to a stationary contact member with their inner end. The stationary contact member is brought into operative contact with a movable contact member.

BACKGROUND

Contact straps in multiphase electrical switching devices have a connecting terminal at their outer end and are directly or indirectly connected to a stationary contact member with their inner end, said stationary contact member being brought into and out of contact with a movable contact member. It is known for contact straps to be secured in the switching device housing by pressing them in or embedding them by an injection molding process (DE 19904355 A1), by adhesive bonding (DE 10036350 A1), by a screw connection with a female thread in the switching device housing (DE 29604726 U1), in threaded plates (DE 19814410 A1), or in the contact straps (DE 3232173 C2), by holding them down with housing parts intended for this purpose (EP 645792 A1), by insertion (DE 10061394 A1) or by riveting.

The disadvantages of the known arrangements for securing contact straps are the high technological requirements in terms of equipment, tools and work hours for implementing the attachment, as well as the removal of the contact straps, which is sometimes impossible, sometimes possible only under certain conditions, and sometimes requires considerable effort. For example, in the case of a three-phase contactor having screwed contact straps, a customer who wants to do the manufacturer-recommended replacement of worn contacts with new contacts by himself/herself must unscrew and re-attach at least six screws along with their six retaining elements. Adhesive bonding of the contact straps requires pretreatment of the surfaces as well as curing times. Adhesively bonded parts entail an increased recycling effort.

SUMMARY OF THE INVENTION

It is therefore an object of the present invention to allow easy mounting and removal of the contact straps.

The present invention provides an arrangement for securing contact straps for multiphase switching devices where the switching device housing has straight guide elements for receiving contact straps in their installed position. Each contact strap is provided with a through-hole which, in the installed position, coincides with a receiving hole formed in the switching device housing. Insertion pins extend through the through-holes and into the associated receiving holes. A connecting web combines with said insertion pins to form an insertion comb made of insulating material.

The straight guide elements and the receiving holes in the switching device housing, the through-holes in the contact straps and the one insertion comb per terminal side may provide an arrangement for securing contact straps which enables the contact straps to be firmly secured in position with a few translational assembly movements. Thus, the process of securing the contact straps can be easily automated. In the arrangement of the present invention, there is no need for a female thread in the contact straps or in the switching device housing, or for threaded plates, and the retaining elements needed for screw connections may be dispensed with. Because no iron parts are needed, the conduction of current through the contact straps is not magnetically influenced in a negative way. Both the final attachment and the removal of all contact straps of a terminal side may be carried out with a single movement of the hand by insertion and withdrawal of the insertion comb into and from the through-holes and receiving holes. When the housing cover of the switching device is removed, only two manual operations are required per terminal side for toolless mounting and removal of the contact straps, said manual operations being simple and quick to perform. The insertion comb is much easier to manipulate compared to smaller screws and retaining elements. To facilitate recycling, the insertion comb can be injection-molded from recoverable material. The insertion comb used, which is made of molded insulating material, facilitates compliance with clearance and creepage distance requirements to a significant degree. This problem is increasing in importance due to the trend toward switching devices of smaller and smaller size. The surface of the connecting web of the insertion comb can be used in a practical way for attaching instructions for the customer.

Advantageously, the insertion combs may be clamped with their insertion pins in the through-holes and/or are held down by a housing cover of the switching device.

A practical insertion comb design is a cylindrical or prismatic configuration of the insertion pins, through-holes and receiving holes, for example, featuring a circular or polygonal cross-section. In one advantageous embodiment, the insertion pins are slotted lengthwise to produce the frictional and/or form-locking connection between the through-holes and the receiving holes. Bevels on the free ends of the insertion pins facilitate insertion into the through-holes and receiving holes.

In an advantageous embodiment of the insertion comb, the connecting web is provided with compensating slots for improved compensation of tolerances in the distances between the receiving holes. For better handling, it is advantageous for the connecting web to be shaped like a handle.

To prevent the contact straps inserted in the guide elements from falling out before the insertion comb is inserted, the contact straps may be provided with knobs which bring the contact straps into clamping contact with the guide elements as they are inserted into said guide elements.

In an advantageous refinement of the arrangement, the phase barriers of the switching device housing, i.e., the partitions separating the phases, are provided with receiving slots, which support the inserted insertion comb via its connecting web in a direction parallel to the direction of the terminals, thus contributing to an increase in the permissible tensile and compressive forces on the connecting terminals. To this end, the connecting web provided with compensating slots and the phase barriers provided with the receiving slots are advantageously meshed with each other crosswise.

BRIEF DESCRIPTION OF THE DRAWINGS

Further details and advantages of the present invention will become apparent from the exemplary embodiment described below with reference to the Figures, in which.

DETAILED DESCRIPTION OF AN EMBODIMENT

Figure 1:
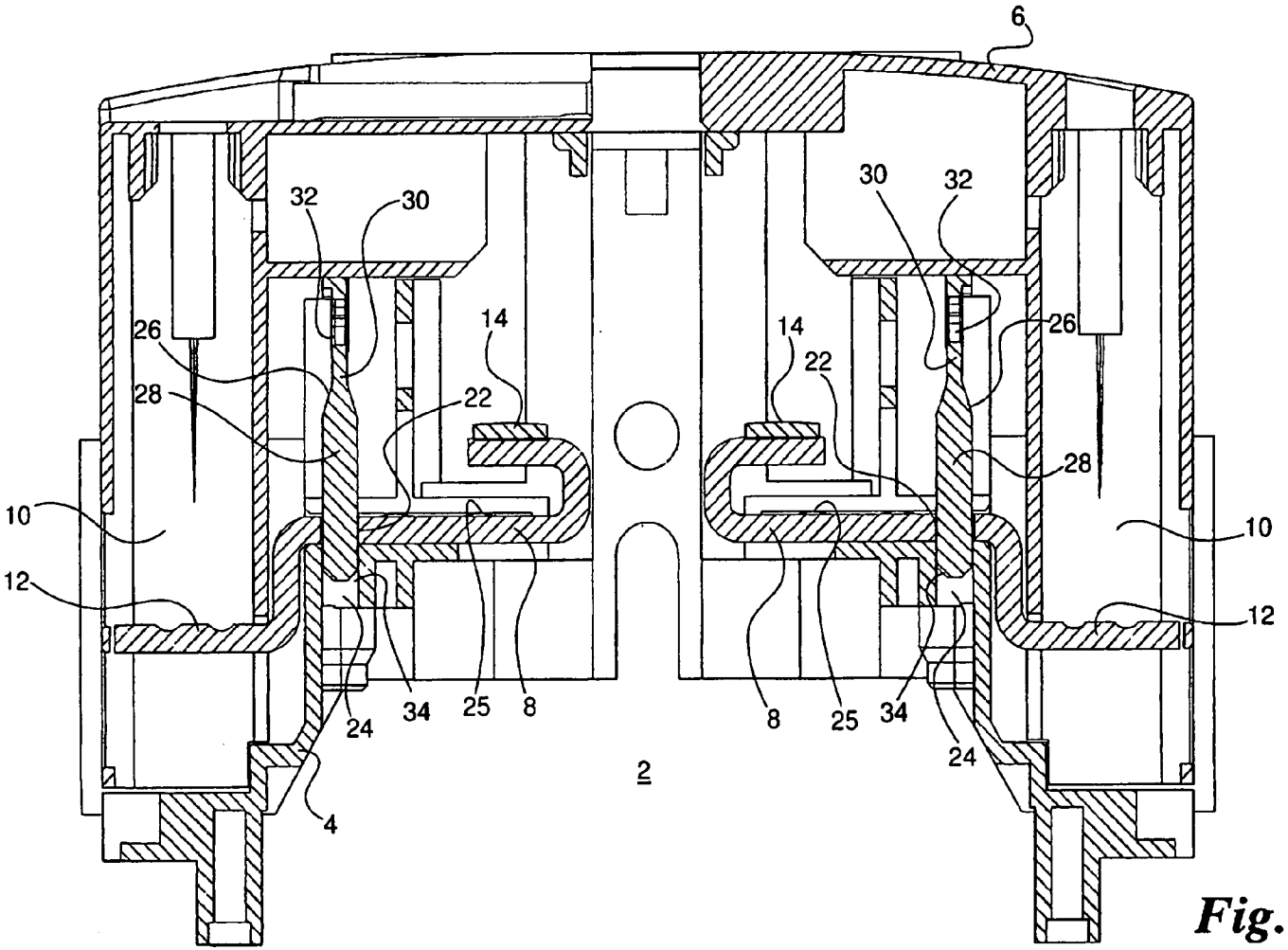
FIG. 1 is a view of an embodiment the securing arrangement according to the present invention, showing essential details of the invention in a switching device shown in a longitudinal cross-section.

The drawing shows the arrangement for securing contact straps, including the parts of a multi-pole switching device 2 in the form of a three-pole contactor that are useful to illustrate one embodiment of the invention. Switching device 2 is surrounded by a switching device housing 4, of which only the upper housing part is depicted in the drawing. Switching device housing 4 is closed at the front by a removable housing cover 6, as shown in FIG. 1. For each current phase, one incoming and one outgoing contact strap 8 is secured in switching device housing 4. Each contact strap 8 is provided at its outer end with a connecting terminal 12 extending into the respective terminal compartment 10, and has a stationary contact member 14 at its inner end. The contact straps 8 belonging to a phase are electrically connected and disconnected by a contact bridge in a usual manner; stationary contact members 14 being brought into and out of contact with movable contact members attached to the contact bridge.

Figure 2:
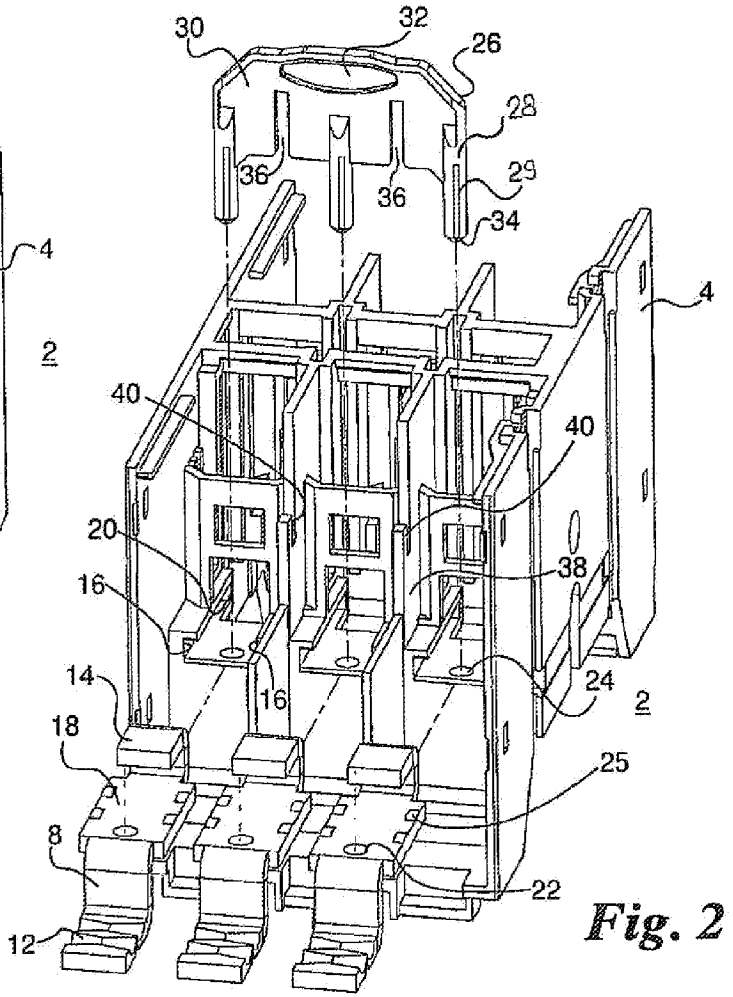
FIG. 2 is an exploded perspective view of the arrangement according to the present invention.
Figure 3:
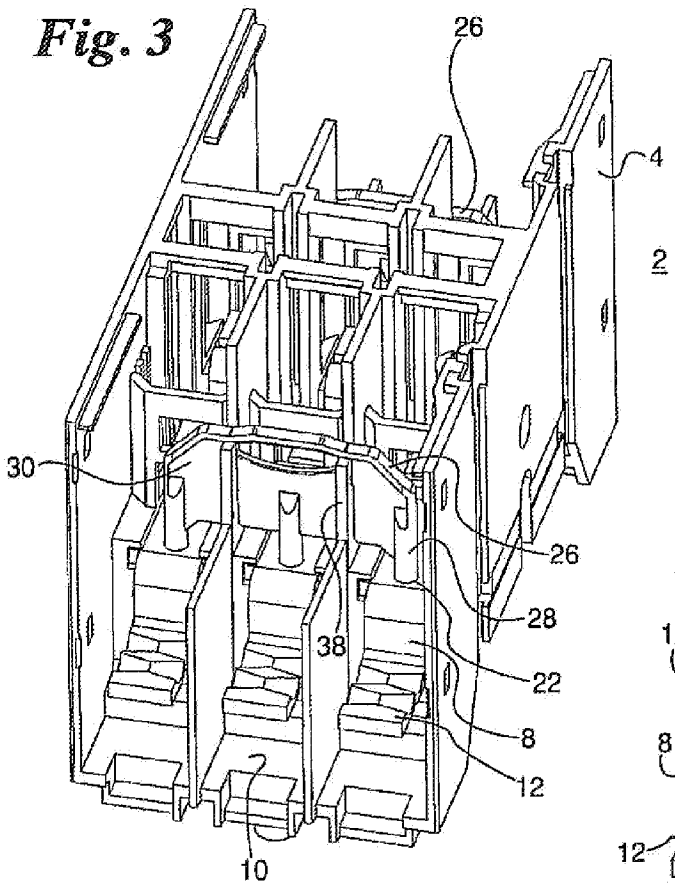
FIG. 3 shows the inventive arrangement in an assembled perspective view.

In switching device housing 4, groove-shaped guide elements 16 are formed in pairs opposite each other on each terminal side for each current phase, as shown in FIG. 2. Plate-like central portion 18 of contact straps 8 is inserted between guide elements 16 until it abuts an end face 20 of guide elements 16 when contact strap 8 is in the installed position, which is shown in FIGS. 1 and 3. Each contact strap 8 is provided with a through-hole 22 which, in the installed position, coincides with a receiving hole 24 formed in switching device housing 4. Contact straps 8 have knobs 25 formed at the edges of the central portion 18, said knobs producing a clamping effect when contact straps 8 are inserted into guide elements 16. This clamping effect is sufficient to prevent contact straps 8 from sliding out of guide elements 16 when transported during the production of switching device 2.

The securing arrangement further includes an insertion comb 26 made of molded insulating material for each terminal side. Insertion comb 26 has one circular cylindrical insertion pin 28 for each current phase. The insertion pins 28 belonging to a terminal side are interconnected by a plate-like connecting web 30. Insertion pins 28 extend in one direction from connecting web 30. Connecting web 30 is provided a handle 32, which is located opposite the insertion pins 28 projecting therefrom.

To secure contact straps 8 in their installed position, insertion combs 26 are inserted with their insertion pins 28 through through-holes 22 of contact straps 8 and into receiving holes 24 of switching device housing 4 such that they are clamped therein. To facilitate insertion, insertion pins 28 are provided with entry bevels 34 at their free ends. To be able to effectively compensate for tolerances in the geometric spacing of receiving holes 24 and insertion pins 28, connecting web 30 is provided with compensating slots 36 between insertion pins 28, said compensating slots being downwardly open as shown in the drawing. In the installed position, insertion combs 26 are additionally held down by the installed housing cover 6.

Switching device housing 4 has continuous inner phase barriers 38 extending lengthwise. As shown in the drawings, upwardly open receiving slots 40 are formed in phase barriers 38 on each terminal side, said receiving slots each being in the same plane as the respective receiving holes 24. Receiving slots 40 receive connecting web 30 of the inserted insertion comb 26. In this condition, firstly, the portions of phase barriers 38 adjacent to receiving slots 40 embrace connecting web 30 on both sides and secondly, at right angles thereto, the portions of connecting web 30 adjacent to compensating slots 36 embrace phase barriers 38 on both sides. In this manner, cross-shaped connections are formed by insertion combs 26 and switching device housing 4.

Due to the partly frictional and partly form-locking connection of contact straps 8 in switching device housing 4, which is provided, on the one hand, by the cooperating elements central portion 18 and guide elements 16 and, on the other hand, by the cooperating elements receiving holes 24, insertion pins 28 and through-holes 22, a simple, reliable, and easily removable securing arrangement is implemented. Insertion pins 28 are subjected to shear stress, especially when tensile loads are applied to the terminals. The cross-sectional area of insertion pins 28, in conjunction with the material to be selected, has to be such that it withstands the expected loads. Due to the geometric design shown, insertion comb 26 is largely unaffected by tolerances. Phase spacing differences of switching device housing 4 in the millimeter range can be coped with by insertion comb 26 without difficulty. In order that the attention of the customer doing the removal and mounting work is attracted to insertion combs 26, it is recommended for these parts to have a color distinctly different from switching device housing 4.

The present invention is not limited to the specific embodiments described above but includes also all equally acting embodiments along the lines of the present invention. Thus, for example, the present invention can be developed such that the insertion pins have single or crisscross slits 29 as shown in FIG. 2 along their longitudinal axis in order to produce an elastic clamping force.

What is claimed is:

1. An arrangement for securing contact straps for multiphase switching devices comprising:

a switching device housing having straight guide elements and receiving holes;

contact straps received in an installed position in the switching device housing via the guide elements, each contact strap having a connecting terminal at an outer end and a stationary contact member at an inner end, the stationary contact member capable of being brought into operative contact with a movable contact member, each contact strap being provided with a through-hole, the through-holes in the installed position coinciding with one of the receiving holes in the switching device housing; and an insertion comb having insertion pins extending through the through-holes and into the associated receiving holes and a connecting web connecting the insertion pins, the insertion comb being made of insulating material.

2. The arrangement as recited in claim 1 wherein the insertion pins are clamped in the receiving holes.

3. The arrangement as recited in claim 1 further comprising a housing cover holding down the insertion comb.

4. The arrangement as recited in claim 1 wherein the insertion pins, through-holes and receiving holes have a cylindrical or prismatic shape.

5. The arrangement as recited in claim 1 wherein the insertion pins have a slit along a longitudinal axis.

6. The arrangement as recited in claim 1, wherein the insertion pins have an entry bevel at a free end.

7. The arrangement as recited in claim 1, wherein connecting web has compensating slots between the insertion pins, said compensating slots being open on one side and extending parallel to the insertion pins.

8. The arrangement as recited in claim 1 wherein the connecting web includes a handle opposite the insertion pins.

9. The arrangement as recited in claim 1 wherein the contact straps have knobs in clamping contact with the guide elements.

10. The arrangement as recited in claim 1 wherein the switching device housing has phase barriers with receiving slots receiving the connecting web.

11. The arrangement as recited in claim 10 wherein the connecting web has compensating slots brought into a cross connection with the receiving slots.

* * * * *